US007007595B2

(12) United States Patent
Ozery et al.

(10) Patent No.: US 7,007,595 B2
(45) Date of Patent: Mar. 7, 2006

(54) DEVICE AND METHOD FOR COMPUTERIZED PRODUCT SLICING

(76) Inventors: Shalom Ozery, Rechov Achimeir 14, Tel-Aviv (IL) 69126; Eldad Rubin, Rechov Dizengof 175, Tel-Aviv (IL)

( * ) Notice: Subject to any disclaimer, the term of this patent is extended or adjusted under 35 U.S.C. 154(b) by 0 days.

(21) Appl. No.: 10/360,711

(22) Filed: Feb. 10, 2003

(65) Prior Publication Data

US 2004/0154445 A1 Aug. 12, 2004

(51) Int. Cl.
*B26D 7/30* (2006.01)

(52) U.S. Cl. ..... 99/537; 83/77; 83/932

(58) Field of Classification Search ..... 83/719–728, 83/932, 703, 77; 700/167; 53/502; 221/93–94; 99/537, 589; 177/60
See application file for complete search history.

(56) References Cited

U.S. PATENT DOCUMENTS 3,894,457 A * 7/1975 Miller et al.. ..... 83/27
4,065,911 A 1/1978 Fagan
4,136,504 A * 1/1979 Wyslotsky ..... 83/13
4,231,465 A * 11/1980 Bourgeois ..... 198/460.1
4,545,447 A 10/1985 Spooner et al.
4,548,107 A * 10/1985 Marchese et al. ..... 83/23
4,598,618 A 7/1986 Kuchler
4,603,610 A * 8/1986 Whitehouse ..... 83/13
5,076,124 A * 12/1991 Whitehouse ..... 83/105
5,107,731 A * 4/1992 Kent ..... 83/91
5,109,936 A * 5/1992 Ruppel ..... 177/25.19
5,216,960 A * 6/1993 Kuchler ..... 83/721
5,481,466 A * 1/1996 Carey ..... 83/364
6,213,863 B1 * 4/2001 Basile et al. ..... 452/127
6,320,141 B1 * 11/2001 Lindee et al. ..... 177/25.13
6,722,267 B1 * 4/2004 Ciprietti et al. ..... 83/932
2002/0184983 A1 12/2002 Lau et al.
2003/0070525 A1 * 4/2003 Barnhart ..... 83/932
2004/0134319 A1 * 7/2004 Sandberg ..... 83/13

FOREIGN PATENT DOCUMENTS

WO WO9933620 7/1999

* cited by examiner

*Primary Examiner*—Stephen Choi
(74) *Attorney, Agent, or Firm*—Dekel Patent Ltd.; David Klein

(57) ABSTRACT

A device and method for computerized product slicing are disclosed. The device includes a blade, an openable product holder capable of engaging/retaining therein the product and of communication with a product sensor, the product sensor which detects presence of product in proximity to the product holder and causes it to close upon the product, a slicing mechanism, and a weighing module designed and constructed to collect, retain and weigh slices of product and to communicate weight thereof to a CPU which accepts a data input from a user. The CPU is essentially responsible for control of the device and for display of data on a display included in the device. A method including the sequence of actions performed by the device is further disclosed.

4 Claims, 4 Drawing Sheets

70 (51)

DEVICE AND METHOD FOR COMPUTERIZED PRODUCT SLICING

FIELD AND BACKGROUND OF THE INVENTION

The present invention relates to a device and method for computerized product slicing and, more particularly, to a device and method for producing neat stacks of sliced product. The claimed invention is expected to find especial utility in slicing food products, especially meats and cheeses.

Many food slicing devices/methods are known in the art. A brief summary is provided here to emphasize the novelty of the claimed invention. This summary does not purport to be an exhaustive analysis of all prior art slicers or slicing methods.

U.S. Pat. No. 4,598,618 teaches production of slices which are deposited on a support in a plurality of rows with the slices in each row offset from one another by a predetermined first distance and the rows offset from each other by a predetermined second distance. This patent teaches against stacking of slices produced by the slicer. Further, teachings of this patent do not include detection of product presence in the device.

U.S. Pat. No. 4,545,447 teaches stacking and weighing slices coming from the discharge end of a slicing machine. The apparatus is initially set to receive slices in stacked form on a stacker. Teachings of this patent emphasize a profile compensation control system to maintain uniform weight between stacks. The profile compensation control system is provided to compensate for tapers on the rear and front ends of a load to be sliced and accordingly adjust the slice thickness and obtain uniform and acceptable stack weights. Thus, teachings of this patent have as an inherent disadvantage non-uniform slice thickness in at least some of the stacks. Further, teachings of this patent are ill suited to "custom slicing" situations where a different stack weight is desired for each successive slicing operation or where different products are sliced successively (e.g. delicatessen or supermarket counters). Further, teachings of this patent do not include detection of product presence in the device.

U.S. Pat. No. 4,065,911 teaches monitoring weight of accumulated slices of meat in a first slicing operation in order to ascertain slicing parameters for a subsequent slicing operation with a similar desired target weight. teachings of this patent are ill suited to "custom slicing" situations where a different stack weight is desired for each successive slicing operation or where different products are sliced successively (e.g. delicatessen or supermarket counters). Further, teachings of this patent do not include detection of product presence in the device.

U.S. Patent Application 20020184983 teaches a food slicer which weighs accumulated slices and displays the accumulated weight. These teachings do not include input of data to a CPU for control of a slicing operation. Further, teachings of this application do not include detection of product presence in the device.

PCT application WO9933620 teaches an automatic food slicer but fails to teach detection of product presence in the device.

There is thus a widely recognized need for, and it would be highly advantageous to have, device and method for computerized product slicing devoid of the above limitations.

SUMMARY OF THE INVENTION

According to one aspect of the present invention there is provided a computerized product-slicing device. The device includes: (a) at least one blade; (b) a product holder having at least two operational states including a first operational state in which the product holder is open to accept the product and a second operational state in which the product holder is closed upon the product so that the product is engaged and retained therein; the product holder capable of communication with a product presence sensor; (c) the product presence sensor designed and constructed to detect presence of the product in proximity to the product holder and to cause the product holder to switch from the first operational state to the second operational state when the presence of the product in proximity to the product holder is detected; (d) a slicing mechanism designed and constructed to cause repeated passage of the blade through the product so that slices thereof are produced, (e) a weighing module designed and constructed to collect, retain and weigh the slices of the product produced by the slicing mechanism and to communicate a determined weight thereof to a computerized processing unit (CPU); (f) the CPU designed and configured to accept a data input from a user of the device via a data input mechanism; receive the determined weight from the weighing module; and to control operation of the slicing mechanism and the product holder; and (g) a display device designed and constructed to display at least one item selected from the group consisting of the data input, the determined weight, a number of slices currently present in the weighing module, and an item of information pertaining to the product.

According to another aspect of the present invention there is provided a method of slicing a product in accord with user input. The method includes: (a) accepting a data input from the user via a data input mechanism in communication with a computerized processing unit (CPU); (b) employing a product presence sensor to detect presence of the product in proximity to a product holder; (c) causing the product holder to switch from a first operational state in which the product holder is open to accept the product to a second operational state in which the product holder is closed upon the product so that the product is engaged and retained therein in response to a signal from the product presence sensor; (d) operating a slicing mechanism to cause repeated passage of at least one blade through the product so that slices thereof are produced according to the data input, wherein the operating is controlled by the CPU; (e) collecting, retaining and weighing the slices of the product produced by the slicing mechanism within a weighing module designed and constructed to communicate a determined weight thereof to the CPU; and (f) displaying upon a display device at least one item selected from the group consisting of the data input, the determined weight, a number of slices currently present in the weighing module, and an item of information pertaining to the product.

According to further features in preferred embodiments of the invention described below, the data input includes at least one item selected from the group consisting of a weight of product desired, a number of slices of product desired, a price, and a product selection.

According to still further features in the described preferred embodiments the CPU is further designed and configured to cause the product holder to return to the first operational state when the product in the weighing module conforms to the data input from the user.

According to still further features in the described preferred embodiments a plurality of devices are in communication with a central control unit so that a plurality of products may be concurrently prepared for the user.

According to still further features in the described preferred embodiments a plurality of devices are in communication with a central control unit so that at least one product may be concurrently prepared according to a plurality of the data inputs from a plurality of the users.

According to still further features in the described preferred embodiments the device further includes a product identification sensor designed and constructed to identify the product and communicate information pertaining thereto to the CPU.

According to still further features in the described preferred embodiments the information pertaining thereto includes at least one item selected from the group consisting of a price per unit, a slicing parameter, a product name and a product code.

According to still further features in the described preferred embodiments the device further includes a wrapping unit designed and constructed to wrap the slices of product.

According to still further features in the described preferred embodiments the device, further includes a printer in communication with the CPU, the printer designed and constructed to print a label containing at least price information pertaining to the slices in the weighing module in response to a command from the CPU.

According to still further features in the described preferred embodiments the device further includes a product retrieval mechanism designed and constructed to select a product from among a plurality of products, retrieve the selected product and deliver the selected product to the product holder of the device.

According to still further features in the described preferred embodiments the device further includes a second weighing module designed and constructed weigh the product prior to slicing by the slicing mechanism and to communicate a determined weight thereof to the computerized processing unit (CPU).

According to still further features in the described preferred embodiments the accepting the data input includes accepting at least one item selected from the group consisting of a weight of product desired, a number of slices of product desired, a price, and a product selection.

According to still further features in the described preferred embodiments the method further includes causing the product holder to return to the first operational state when the product in the weighing module conforms to the data input from the user by means of a command from the CPU.

According to still further features in the described preferred embodiments the method further includes employing a product identification sensor to identify the product and communicate information pertaining thereto to the CPU.

According to still further features in the described preferred embodiments wherein the information pertaining thereto includes at least one item selected from the group consisting of a price per unit, a slicing parameter, a product name and a product code.

According to still further features in the described preferred embodiments the method further includes wrapping the slices of product by means of a wrapping module.

According to still further features in the described preferred embodiments the method further includes printing a label containing at least price information pertaining to the slices in the weighing module in response to a command from the CPU.

According to still further features in the described preferred embodiments the method further includes employing a product retrieval mechanism to select a product from among a plurality of products retrieve the selected product and deliver the selected product to the product holder.

According to still further features in the described preferred embodiments the method further includes weighing the product prior to slicing by the slicing mechanism and to communicating a determined weight thereof to the computerized processing unit (CPU).

According to still further features in the described preferred embodiments an account debit mechanism debits a user account.

The present invention successfully addresses the shortcomings of the presently known configurations by providing a device for computerized product slicing which detects the presence of product in the device. The claimed method includes product detection.

Implementation of the method and system of the present invention involves performing or completing selected tasks or steps manually, automatically, or a combination thereof. Moreover, according to actual instrumentation and equipment of preferred embodiments of the device and method of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
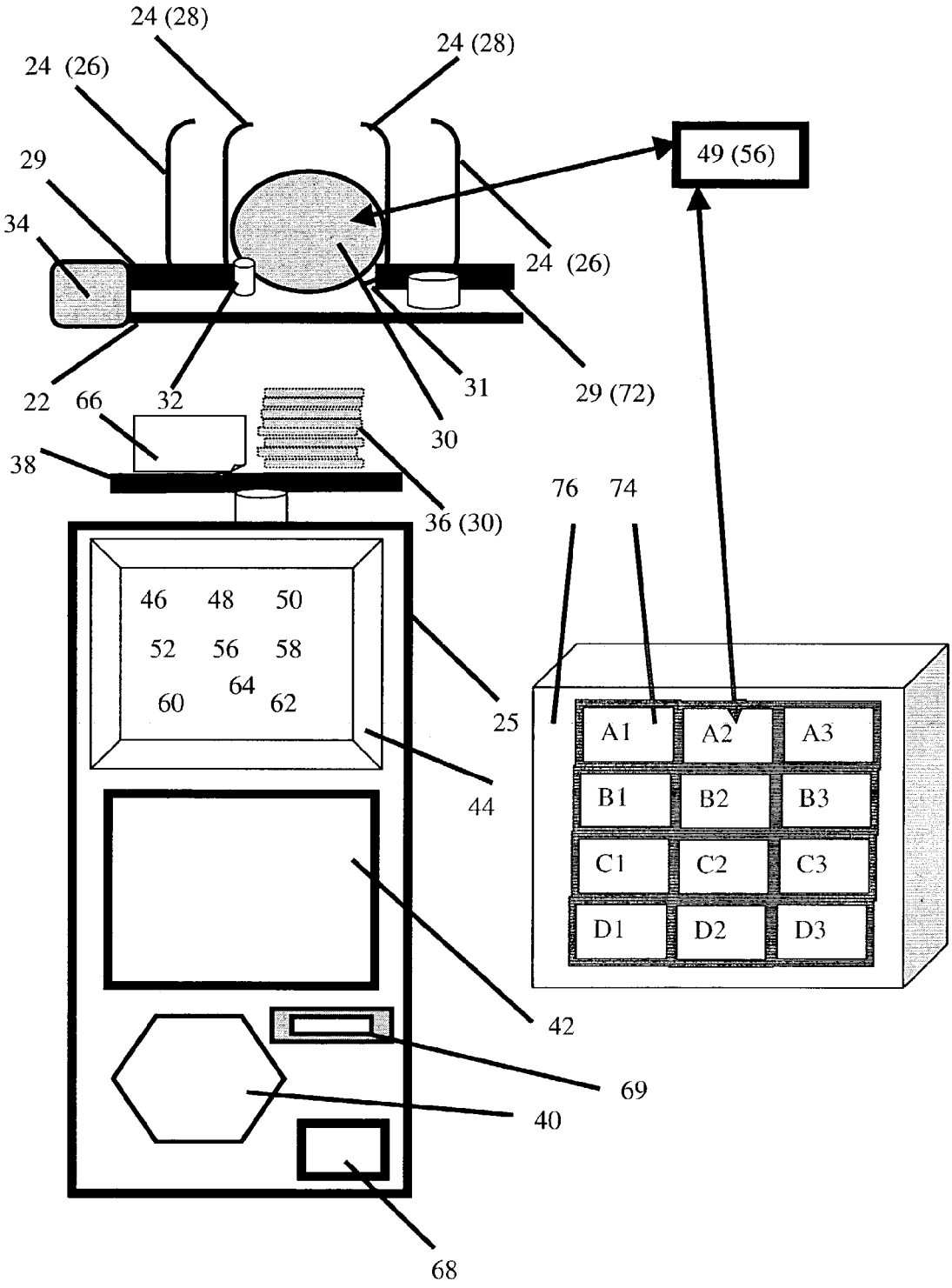
FIG. 1 is a diagrammatic representation of a possible arrangement of components of a device according to the present invention.

The present invention is of a device and method for computerized product slicing which detects the presence of product to be sliced.

Specifically, the present invention can be used to slice food products, such as meats or cheeses. The invention is expected to find especial utility in situations in which successive slicing operations are different from one another. These differences may arise from differences in product type, selected slice thickness or desired total weight of product to be sliced. Thus, in contrast to the prior art, which offers solutions for repeatedly producing similar weights of the same product in a factory, the present invention is especially suited for use in delicatessens, restaurants and supermarkets where it is likely that each slicing operation will differ from the previous slicing operation.

The principles and operation of a device and method according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIG. 1 illustrates a computerized product-slicing device 20 according to the present invention. For purposes of this specification and the accompanying claims, the term "product" specifically includes, but is not limited to, food products such as meats and cheeses. Meats may be, for example, cured meats such as sausages, smoked meats or pickled meats. Alternately or additionally, fresh meats may be included in the term product. An example of other non-food products which may be sliced by a device such as described herein is rubber.

Device 20 includes at least one blade 22. One of ordinary skill in the art of food processing engineering will be well acquainted with commercially available food slicing blades and will be able to incorporate an available blade into device 20. Briefly, blade 22 may be, for example a rotating disk with a circumferential cutting edge, a straight edged blade or a band saw blade. Device 20 further includes a product holder 24 having at least two operational states. These operational states include a first operational state 26 in which product holder 24 is open to accept a product 30 and a second operational state 28 in which product holder 24 is closed upon product 30 so that product 30 is engaged and retained therein. Product holder 24 is capable of communication with a product presence sensor 32 which may be, for example, an electric eye, a mechanical switch, a weight sensitive device or a bar code reader. Communication may be via any available channel of communication. For purposes of this specification and the accompanying claims, the phrase "channel of communication" refers to a physical connection (e.g. wired or hard wired), a local area network connection, an infrared frequency transmission connection, a fiber-optic connection, a radio frequency connection, a telephone connection (including cellular) or an Internet connection. Inherent in the idea of a communication channel is an open status during which data transmission may occur. In some cases, communication channels may also have a closed status during which no data transmission may occur.

Product presence sensor 32 is designed and constructed to detect presence of product 30 in proximity to product holder 24 and to cause product holder 24 to switch from first operational state 26 to second operational state 28 when presence product 30 in proximity holder 24 is detected. Switching between operational states may be accomplished either directly or via communication with intermediary components as detailed hereinbelow.

Device 20 further includes a slicing mechanism 34 designed and constructed to cause repeated passage of blade 22 through product 30 so that slices 36 thereof are produced. Preferably, slicing is of a portion of product 30 which protrudes through hole 31 in table 29.

Device 20 further includes a weighing module 38 designed and constructed to collect, retain and weigh slices 36 of product 30 produced by the slicing mechanism 34 and to communicate a determined weight thereof to a computerized processing unit (CPU) 40 via a channel of communication as defined hereinabove.

Device 20 further includes CPU 40 designed and configured to accept a data input from a user of device 20 via a data input mechanism 42. The data input may include, for example, a weight 46 of product 30 desired, a number 48 of slices 36 of product 30 desired, a price 50, a product selection 52 or a combination including at least one of these parameters. For purposes of this specification and the accompanying claims the phrase "data input mechanism" refers to any device for entry of data to a computing device. The definition includes, but is not limited to a keyboard/keypad, a computer mouse, a track pad, a track ball, a stylus, a touch screen and a microphone.

CPU 40 is further designed and configured to receive the determined weight from weighing module 38 and to control operation of slicing mechanism 34 and product holder 24. For example CPU 40 may cause product holder 24 to return to first operational state 26 when product 30 in weighing module 38 conforms to the data input from the user.

Device 20 further includes a display device 44 designed and constructed to display at least one item such as, for example, the data input (e.g. 46; 48; 50 or 52), the determined weight, a number of slices 36 currently present in weighing module 38, and an item of information pertaining to product 30.

According to some preferred embodiments (FIG. 2) of device 20 a plurality of slicing mechanisms 34 and weighing modules 38 are in communication with a central control unit 54 so that a plurality of products 30 may be concurrently prepared for the user. According to alternate preferred embodiments of device 20 a plurality of slicing mechanisms 34 and weighing modules 38 are in communication with a central control unit 54 so that at least one product 30 may be concurrently prepared according to a plurality of data inputs from a plurality of the users.

Preferably device 20 further includes a product identification sensor 56 designed and constructed to identify product 30 and communicate information pertaining thereto to CPU 40. The information pertaining to product 30 may include, for example, a price per unit 58, a slicing parameter 60 (e.g. minimum or maximum thickness), a product name 62 or a product code 64. Product identification sensor 56 may be, for example, a bar code reader or a microchip reader.

For purposes of this specification and the accompanying claims the term "microchip" refers to a machine-writeable and machine-readable device capable of storing electronic data. "Micro", in this case, does not mean that the chip is not visible to the naked eye. An example of a microchip suitable for use in the present invention is the Tag-It™ TIRIS™ (Texas Instruments™, U.S.A.). TIRIS™ employs sequential transmission of FM signals and electronic data capture. Primary to each TIRIS™ system are transponders, each of which is especially programmable with a unique code.

TIRIS™ employs radio transmissions to send energy to a transponder which returns a radio transmissions back to a data collection reader. The TIRIS™ transponder (tag) is attachable to product 30. A TIRIS™ reader-unit in sensor 56 sends a radio frequency wave to the tag, and the tag broadcasts its stored data back to the reader. Data collected from a transponder is transmitted to CPU 40.

Preferably, device 20 further includes a wrapping unit 66 designed and constructed to wrap slices 36 of product 30. Preferably, device 20 further includes a printer 68 in communication with CPU 40. Printer 68 is designed and constructed to print a label containing at least price information pertaining to slices 36 in weighing module 38 in response to a command from the CPU. More preferably, printer 68 and wrapping unit 66 are functionally integrated so that a label produced by printer 68 is affixed to a wrapped package of slices 36 produced by wrapping unit 66. This may be accomplished, for example, by printing of a label directly on paper employed by wrapping unit 66 to wrap slices 36. Alternately, this may be accomplished by printing of adhesive labels which are affixed to the wrapped package.

Most preferably, device 20 further includes an account debit mechanism which relies upon magnetic carder reader 69 to read details of an ATM card (Automatic teller machine card) and transmit details thereof via an available channel of communication to an established transaction authorization server. Transaction authorizations of this type are well known and can easily be incorporated into device 20 by one of ordinary skill in the art. For purposes of this specification and the accompanying claims the term "account" refers to any calculation of monetary indebtedness. This definition specifically includes, but is not limited to, a credit card account, a bank account and a customer account with a commercial entity (e.g. store account). For purposes of this specification and the accompanying claims, the phrase "ATM card" refers to any card readable by an ATM machine including, but not limited to a credit card and a debit card. Specifically included in this definition are Visa™ cards, MasterCard™, American Express™ cards, Diners Club™ cards, JCB™ cards and any functional equivalents thereof.

Thus, according to a most preferred embodiment of the invention, the label printed by printer 68 is also receipt for the contents of at least one package wrapped by wrapping unit 66.

Figure 3:
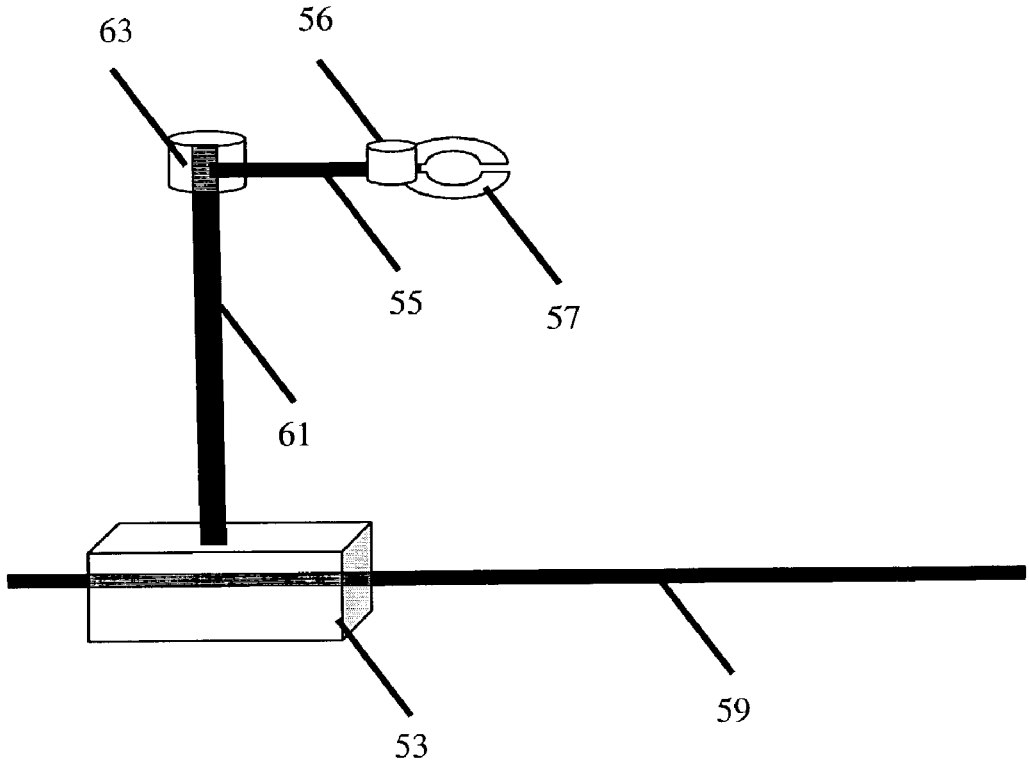
FIG. 3 illustrates one embodiment of a product retrieval mechanism according to the present invention.

Preferably device 20 further includes a product retrieval mechanism 70 designed and constructed to select product 30 from among a plurality of products, retrieve selected product 30 and deliver selected product 30 to product holder 24 of device 20. One preferred embodiment of retrieval mechanism 70 is a robotic device 51 as illustrated in FIG. 3. Robotic device 51 employs a robotic arm 55 which serves for retrieving and placing product 30 in product holder 24. Arm 55 is equipped with a fingered gripper 57 at its distal end, for example of the type sold by Sommer Automatic (U.S.) which is capable of picking up product 30 and accurately placing product 30 in product holder 24. Robotic device 51 may be configured in many different ways without significantly changing the overall function of device 20. One configuration, as shown in FIG. 3 is now described in detail as a non-limiting example. According to one preferred embodiment of the invention, robotic device 51 includes a base 53 horizontally translatable along a guiding rail 59. Horizontal translation may be achieved, for example by means of complementary arcuate teeth on rail 59 and base 53. Rail 59 serves to allow travel of robotic device between holder 24 and an ordered array of discrete locations 74. A user may input a discrete location (e.g. B2) or designate a product 30 by name. In either case, identification sensor 56 communicates details of retrieved product 30 to CPU 40. Robotic device 51 further includes a vertical shaft element 61 vertically extending from base 53, and a motorized operative head 63 translatably engaged by vertical shaft 61 and which is equipped with at least one rotating robotic arm 55 so as to allow a distal end of robotic arm 55 least three degrees of freedom. Base 53 and operative head 63 are controlled by CPU 40 so that retrieval of product 30, placement in holder 24 and return of unsliced product 30 to discrete location 74 is performed in response to a the initial user input. Since product 30 is most often perishable, discrete locations 74 are typically within a refrigerated display case 76. Display case 76 may also house Slicing mechanism 34 and/or other portions of device 20.

Preferably, device 20 further includes a second weighing module 72 designed and constructed weigh product 30 prior to slicing by slicing mechanism 34 and to communicate a determined weight thereof to CPU 40. Second weighing module 72 is preferably incorporated into product table 29.

Figure 4:
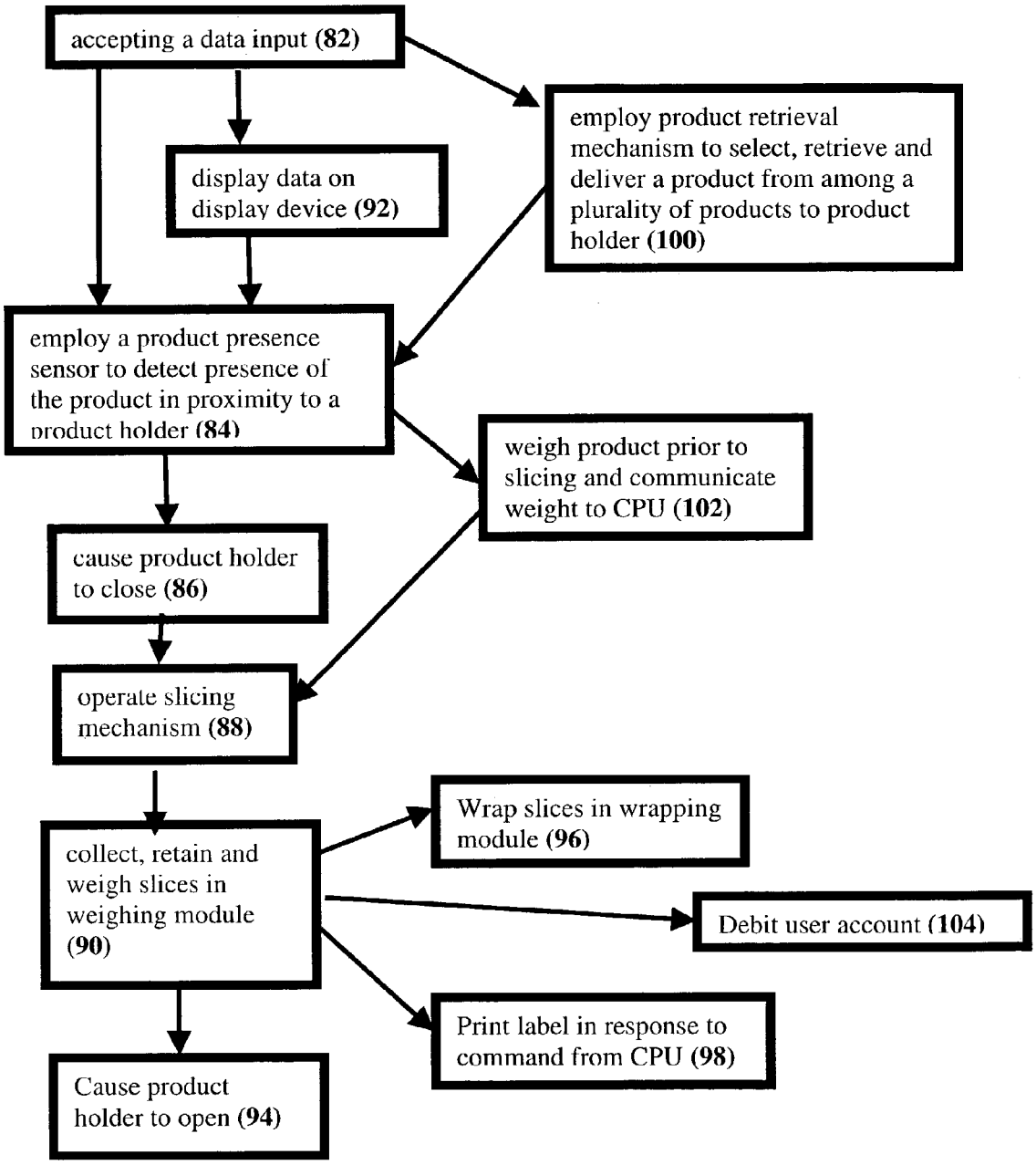
FIG. 4 is a simplified flow diagram illustrating methods according to the present invention.

Thus, the present invention is further embodied by a method 80 (FIG. 4) of slicing a product in accord with user input. Method 80 includes accepting 82 a data input from the user via data input mechanism 42 in communication with CPU 40. Accepting the data input may includes accepting, for example, one or more of a weight of product desired 46, a number of slices of product desired 48, a price 50, or a product selection 52.

Method 80 further includes employing 84 a product presence sensor 32 to detect presence of product 30 in proximity to product holder 24.

Method 80 further includes causing 86 product holder 24 to switch from a first operational state 26 in which holder 24 is open to accept the product to a second operational state 28 in which holder 24 is closed upon product 30 so that product 30 is engaged and retained therein in response to a signal presence sensor 32. Sensor 32 may communicate with holder 24 either directly, or via CPU 40.

Method 80 further includes operating 88 slicing mechanism 34 as described hereinabove under the control of CPU 40.

Method 80 further includes collecting 90, retaining and weighing the slices 36 of product 30 produced by slicing mechanism 34 within a weighing module 38 which is designed and constructed to communicate a determined weight thereof to CPU 40.

Method 80 further includes displaying 92 upon a display device data such as, for example, the data input (e.g. weight of product desired 46, number of slices desired 48, price 50, product selection 52, the determined weight of sliced product, a number of slices currently present in weighing module 38, or an item of information pertaining to the product as described hereinabove.

Preferably, method 80 further includes causing 94 product holder 24 to return to first operational state 26 when product 30 in weighing module 38 conforms to the data input from the user by means of a command from CPU 40.

Preferably, method 80 further includes employing a product identification sensor 56 to identify the product and communicate information pertaining thereto to the CPU as detailed hereinabove.

Preferably, method 80 further includes wrapping 96 slices 36 of product 30 by means of wrapping module 66.

Preferably, method 80 further includes printing 98 a label containing at least price information pertaining to slices 36 in weighing module 38 in response to a command from CPU 40.

Preferably, method 80 further includes employing 100 a product retrieval mechanism 70 to select product 30 from among a plurality of products 30, retrieve selected product 30 and deliver selected product 30 to holder 24.

Preferably, method 80 further includes weighing product 30 prior to slicing by slicing mechanism 34 and communicating a determined weight thereof to CPU 40. This is accomplished by second weighing module 72. This determined weight may be compared to a desired weight input by the user. If the desired weight is greater than the actual weight of product in holder 24, the user is queried about how to proceed (e.g. "Will you accept the lower weight?"; "Will you allow slicing from two pieces of product?"). If the desired weight is less than the actual weight of product in holder 24, the CPU operates slicing mechanism 34 without additional user input.

Preferably, method 80 further includes debiting 104 a user account. As a non limiting example of the advantages of the present invention with respect to available alternatives the following narrative illustration is provided. A shopper steps up to the delicatessen counter in a supermarket. There is no human attendant in evidence. Instead, the shopper finds an ordered array of discrete locations 74 in a refrigerated display case 76. Each location in array 74 contains a sliceable product which is identifiable and/or labeled. In close proximity to display 76 is a large touch-screen display 44 which also serves as a data input mechanism 42. The screen reads "May I help you?". The shopper touches the "yes" button on the screen to activate device 20. Shopper is then prompted to enter an order specifying product 30 either by name (e.g. selection from a list on the screen) or by location (e.g. B2) and an amount (e.g. weight desired; number of slices desired, total transaction amount desired).

Optionally, but preferably, screen 44 prompts shopper to select a payment type. If debit card or credit card is selected, a prompt to insert the card in card reader 69 appears on the screen. Insertion of the card initiates a standard transaction verification procedure with a remote transaction server. In some cases, the shopper may be required to enter a PIN code, for example via touch screen 44 (42). If cash is selected, CPU 40 instructs printer 68 to include a machine readable price (e.g. bar code) on the label to be printed for the current slicing operation.

This information is communicated to CPU 40 which sends product retrieval mechanism 70 in the form of robotic device 51 to select 100, retrieve and place desired product 30 in holder 24 which is open 26. This triggers 84 sensor 32, which sends a signal to CPU 40 causing 86 holder 24 to close 28 upon product 30. CPU 40 then operates slicing 34 in accord with accepted data input 82. Slices 36 of product 30 are collected 90 in an essentially vertical stack in weighing module 38 until CPU 40 determines that the sliced product 30 conforms to initially accepted data input 82. At that time wrapping unit 66 wraps the sliced product. Printer 68 concurrently prints a label including the package price which is affixed to the wrapped package either by wrapping unit 66 or by the shopper. Preferably, the label includes a bar coded price for use at a check-out point. More preferably, the label is a receipt for a credit or debit card transaction which has already been authorized while slicing occurs as described hereinabove.

Figure 2:
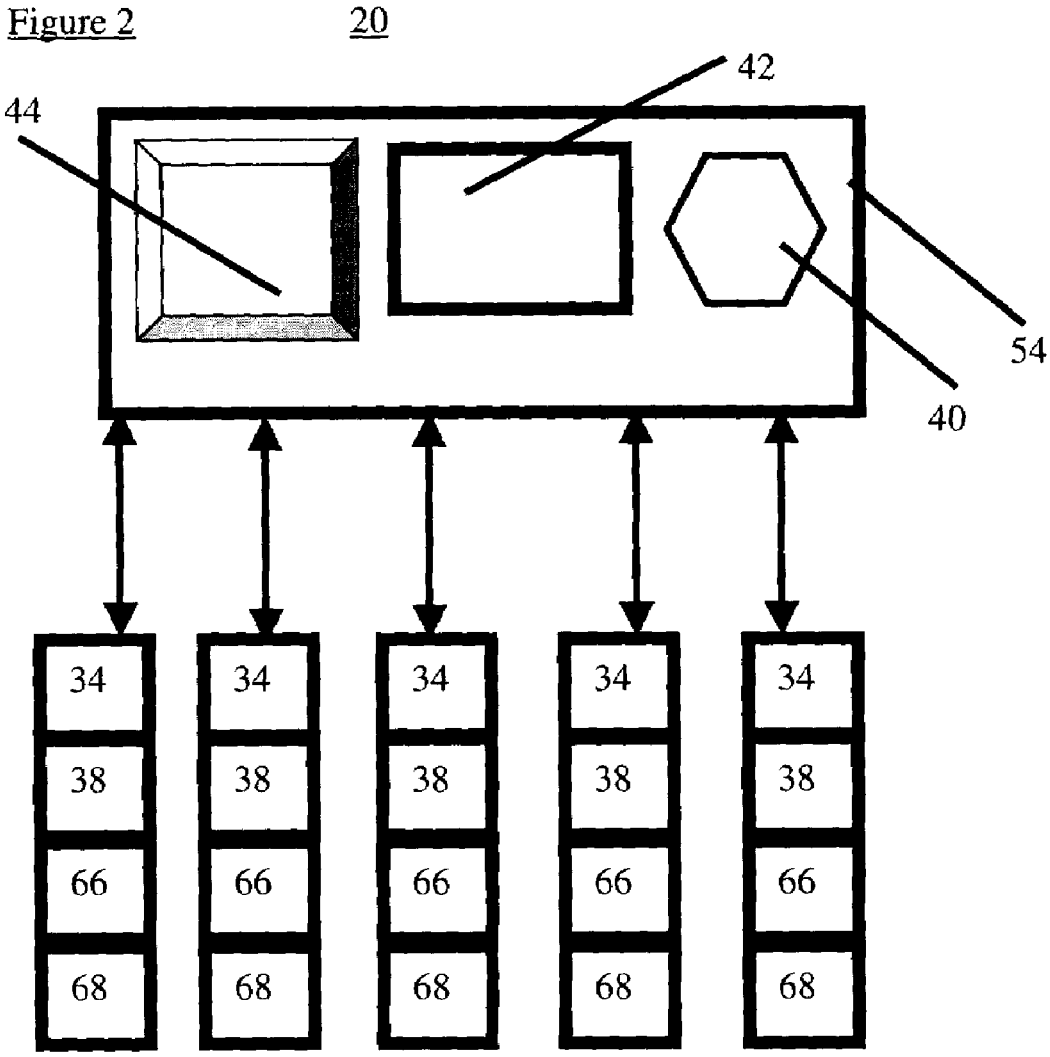
FIG. 2 is a diagrammatic representation of a device according to the present invention which relies upon a central control unit so that it can concurrently perform multiple slicing operations.

According to some embodiments of the invention, a shopper may concurrently order several different slicing operations (see FIG. 2). Thus, the present invention reduces the need for human personnel at food slicing counters and expedites the process of paying for sliced products.

It is expected that during the life of this patent many relevant "robotic devices" and "sensors" will be developed and the scope of these terms is intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A computerized product slicing device, the device comprising:

(a) at least one blade;

(b) a product holder having at least two operational states including a first operational state in which said product holder is open to accept the product and a second operational state in which said product holder is closed upon the product so that the product is engaged and retained therein; said product holder capable of communication with a product presence sensor;

(c) said product presence sensor designed and constructed to detect presence of the product in proximity to said product holder and to cause said product holder to switch from said first operational state to said second operational state when said presence of the product in proximity to said product holder is detected;

(d) a slicing mechanism designed and constructed to cause repeated passage of said blade through the product so that slices thereof are produced;

(e) a first weighing module designed and constructed to collect, retain and weigh said slices of the product produced by said slicing mechanism and to communicate a determined weight thereof to a computerized processing unit (CPU);

(f) said CPU designed and configured to accept a data input from a user of the device via a data input mechanism; receive said determined weight from said first weighing module; and to control operation of said slicing mechanism and said product holder;

(g) a display device designed and constructed to display at least one item selected from the group consisting of said data input, said determined weight, a number of slices currently present in said weighing module, and an item of information pertaining to the product; and (h) a second weighing module designed and constructed to weigh the product prior to slicing by said slicing mechanism and to communicate a determined weight thereof to said computerized processing unit (CPU); and (i) a wrapping unit designed and constructed to wrap said slices of product;

(j) a printer in communication with said CPU, said printer designed and constructed to print a label containing at least price information pertaining to said slices in said weighing module in response to a command from the CPU;

(k) a product retrieval mechanism designed and constructed to select a product from among a plurality of products, retrieve said selected product and deliver said selected product to said product holder; and (l) a product identification sensor designed and constructed to identify the product and communicate information pertaining thereto to said CPU.

2. The device of claim 1, wherein said data input includes at least one item selected from the group consisting of a weight of product desired, a number of slices of product desired, a price, and a product selection.

3. The device of claim 1, wherein said CPU is further designed and configured to cause said product holder to return to said first operational state when the product in at least one of the first and second weighing modules conforms to said data input from said user.

4. The device of claim 1, wherein said information pertaining thereto includes at least one item selected from the group consisting of a price per unit, a slicing parameter, a product name and a product code.

* * * * *